US007113731B2

(12) United States Patent
Horikoshi et al.

(10) Patent No.: US 7,113,731 B2
(45) Date of Patent: Sep. 26, 2006

(54) TONER SUPPLYING CONTAINER WITH SHUTTER POSITION/DETECTION PORTION SENSOR FEATURE AND IMAGE FORMING APPARATUS INCLUDING THE SAME

(75) Inventors: Jun Horikoshi, Chiba (JP); Masashige Tamura, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 235 days.

(21) Appl. No.: 10/823,688

(22) Filed: Apr. 14, 2004

(65) Prior Publication Data

US 2004/0208675 A1 Oct. 21, 2004

(30) Foreign Application Priority Data

Apr. 21, 2003 (JP) ..... 2003-115743

(51) Int. Cl.
*G03G 15/08* (2006.01)

(52) U.S. Cl. ..... 399/258; 399/260; 399/262

(58) Field of Classification Search ..... 399/12, 399/13, 227, 258, 260, 262
See application file for complete search history.

(56) References Cited

U.S. PATENT DOCUMENTS 5,055,881 A * 10/1991 Fukuchi ..... 399/13
5,754,923 A * 5/1998 Yang ..... 399/13
6,185,401 B1 2/2001 Kanamori et al. ..... 399/262
6,807,392 B1 * 10/2004 Cho ..... 399/13

FOREIGN PATENT DOCUMENTS

JP 11-194600 7/1999

* cited by examiner

*Primary Examiner*—William J. Royer
(74) *Attorney, Agent, or Firm*—Fitzpatrick, Cella, Harper & Scinto

(57) ABSTRACT

By a conventional mechanism for detecting a position of a knob of a toner bottle, the detection of the presence or absence of the toner bottle could not be effected. So, by providing an optical sensor on the inner surface of an interchange door opposed to the knob of the toner bottle, it is possible to effect the detection of the presence or absence of the toner bottle, and the detection of the position of the knob, i.e., the opening and closing of a shutter of the toner bottle.

18 Claims, 5 Drawing Sheets

TONER SUPPLYING CONTAINER WITH SHUTTER POSITION/DETECTION PORTION SENSOR FEATURE AND IMAGE FORMING APPARATUS INCLUDING THE SAME

BACKGROUND OF THE INVENTION

1. Field of the Invention

The invention relates to a toner supplying container detachably attachable to a main body of an image forming apparatus such as a copying machine, a printer or a facsimile apparatus using an electrophotographic process or an electrostatic recording process, and an image forming apparatus supplied with a toner from the toner supplying container.

2. Description of the Related Art

A conventional image forming apparatus capable of recording in a plurality of colors has been as follows.

It will hereinafter be described with reference to FIG. 3 of the accompanying drawings. FIG. 3 is a perspective view of a rotary member.

The image forming apparatus has a so-called rotary type developing apparatus having a plurality of developing means (hereinafter referred to as the developing devices 52) and containers (hereinafter referred to as the toner bottles 15) containing therein a plurality of developers (hereinafter referred to as the toners) corresponding thereto circumferentially disposed in a cylindrical rotary member 51.

The reference numeral 51 designates the entire rotary member, the reference numeral 52 denotes the developing devices (of which only 52*y* is shown), and the reference numeral 15 designates the toner bottles (of which only 15*c* and 15*y* are shown). In the present example, there are held the developing devices and toner bottles of three colors, i.e., magenta (suffix m), cyan (suffix c) and yellow (suffix y).

The rotary member 51 is rotated to oppose a developing device 52 of a desired color to a photosensitive member (not shown), thereby visualizing a latent image on the photosensitive member with a toner.

When the toners become exhausted, a user interchanges the toner bottles 15 to thereby supplement.

The rotary member 51 is rotatably held in an apparatus main body (not shown), and has its rotation stoppage controlled at a desired rotational angle and speed by the use of a motor (not shown) provided in the apparatus main body.

The toner bottles 15 are provided with operating levers (hereinafter referred to as the bottle knobs) 1 (1*m*, 1*c*, 1*y*), and by these bottle knobs 1 being operated, the toner bottles 15 can be fixed/released relative to the rotary member 51.

The toner bottles 15 are inserted and removed in the direction of the rotary shaft of the rotary member 51 (the direction of arrow A in FIG. 3).

The surrounding portions of the toner bottle interchanging portion of the apparatus main body will now be described with reference to FIG. 4 of the accompanying drawings.

The reference numeral 11 designates the apparatus main body, and the reference numeral 12 denotes an opening for interchanging the toner bottles 15 therethrough.

When the toners become exhausted during an image forming operation, the apparatus discontinues image forming and calls upon the user to interchange the toner bottle 15 by a message or the like on the display of an operating portion.

The user opens the front cover (not shown) of the apparatus and has access to the opening 12. The user rotates the bottle knob 1 by a predetermined angle to thereby release the toner bottle 15 from the rotary member 51. Then, the user draws out the toner bottle 15 toward the side of the apparatus.

Even in an apparatus having toner bottles 15 of a plurality of colors, the number of the opening 12 for interchanging the toner bottles 15 therethrough is one.

This is because in the actually used state of the apparatus, it is rare that the toners of a plurality of colors become exhausted at the same time.

Further, if a plurality of interchange doors are provided, it will become possible for the user to have access to the plurality of toner bottles 15 and therefore, the toner bottle 15 to be interchanged will be difficult to recognize. Consequently, it is more advantageous to the user that a toner bottle 15 in which the toner has become exhausted waits in the opening 12.

The toner bottle 15 will now be described with reference to FIGS. 5A and 5B of the accompanying drawings. FIG. 5A is a front view of the toner bottle 15. FIG. 5B is a perspective view of a portion of the toner bottle 15.

The reference numeral 2 designates a toner containing portion, and the reference numeral 3 denotes a shutter. The letter S designates a reflection type sensor provided in the apparatus main body 11, and the reference character 1*a* denotes a reflecting surface for reflecting light emitted from the sensor S.

The bottle knob 1 has a rotary shaft parallel to the rotary shaft of the rotary member 51, and the bottle knob 1 is rotated by a predetermined amount to thereby fix or release the toner bottle 15 relative to the rotary member 51. Simultaneously therewith, the opening and closing of the shutter 3 provided in the communicating portion between the toner bottle 15 and the developing device 52, or between the toner bottle 15 and an intermediate hopper portion (not shown) are also effected (see Japanese Patent Application Laid-Open No. H11-194600).

The shutter 3 is opened when the toner bottle 15 is fixed, and is closed when the toner bottle 15 is released.

The intermediate hopper portion is a region having the function of once storing therein the toner from the toner bottle 15 and feeding a desired amount of it into the developing device 52.

The reflecting surface 1*a* is provided on the side surface (circumference) of the bottle knob 1, and the reflection type sensor S is installed so as to detect toward the center of rotation of the bottle knob 1.

When the user rotates the bottle knob 1, the reflecting surface 1*a* comes off from the detection area of the sensor S, whereby it can be detected that the user has rotated the bottle knob 1 or that the toner bottle 15 is in its drawn-out state.

The following problems arise in a case where as shown in the conventional art, the reflecting surface is provided on the side surface (circumference) of the bottle knob 1 and the reflection type sensor S is installed so as to detect toward the center of rotation of the bottle knob 1.

The detecting surface of the reflection type sensor S is near to such portions handling the toner as the shutter 3 and the developing device 52 and therefore, faulty detection due to toner stains is liable to be caused.

If the reflecting surface la is present on the side surface of the rotary member 51, when the rotary member 51 is rotated or stopped, one of the reflecting surfaces 1*a* of the plurality of toner bottles 15 will be stopped while facing substantially upwardly without fail and therefore, the toner is liable to accumulate thereon, and this is liable to cause faulty detection.

When the detecting surface of the reflection type sensor S is stained, to clean it, it is necessary to detach a single piece of the sensor S or the sensor unit from the apparatus main body 11, and this leads to a bad working property.

Usually, after the toner bottle 15 has been interchanged, the user enters the recovery operation of rotating the rotary member 51 several times or rotating the photosensitive member. However, judgment as to whether the toner bottle 15 has been interchanged can be effected only by a front cover opening-closing detection signal (usually the front cover is provided with a sensor for detecting the opening and closing thereof) and therefore, when the user has opened and closed the front cover for some reason or other without interchanging the toner bottle 15, the user performs the recovery operation in spite of the toner bottle 15 having not been interchanged.

This will hereinafter be described with the user's operation and the detection signal made to correspond to each other. First comes the description of a normal procedure.

(1) The toner becomes exhausted during the image forming operation, and image forming is discontinued and therefore, the user is called upon to interchange the toner bottle 15 by a message displayed on an operating portion.

(2) The user opens the front cover of the apparatus (not shown).

(3) The user starts the interchange of the toner bottle 15 with reference to an interchanging method or the like on the display of the operating portion.

(4) The user rotates the bottle knob 1 by a predetermined angle to thereby release the toner bottle 15 from the rotary member 51.

(5) The user draws out the toner bottle 15 toward this side of the apparatus.

(6) The user inserts a new toner bottle 15.

(7) The user rotates the bottle knob 1 by a predetermined angle and fixes it.

(8) The user closes the front cover.

Movements in the image forming apparatus corresponding thereto are as follows.

(1) When the toner becomes exhausted during the image forming operation, the apparatus discontinues image forming, and calls upon the user to interchange the toner bottle 15 by a message on the display of the operating portion.

(2) A sensor signal for opening the front cover is detected.

(3) In response to the signal, the display of the operating portion is changed over to the display of the interchanging procedure.

(4) to (6) (There is no change during the user's interchange of the toner bottle 15.)

(7) The sensor S receives reflected light from the reflecting surface 1*a* to thereby detect the fixing of the toner bottle 15. In response to the signal, the display of the operating portion is changed over to display for calling upon the user to close the front cover.

(8) The closing of the front cover is detected, and the display of the operating portion is returned to the ordinary display. The recovery sequence is started, and after it is completed, image forming is resumed.

An example of the user's abnormal action will now be described.

(1) The toner becomes exhausted during the image forming operation, and image forming is discontinued, the user is called upon to interchange the toner bottle 15 by a message on the display of the operating portion.

(2) The user opens the front cover of the apparatus (not shown).

(3) However, the user becomes aware that they have prepared a toner bottle of a wrong color, and again closes the front cover.

(4) The user has prepared a right bottle, but cannot immediately interchange with it because the apparatus is in operation.

(5) Toner absence is again displayed and the interchange of the toner bottle 15 is resumed (thereafter, normal action takes place).

The movements in the image forming apparatus corresponding thereto are as follows.

(1) When the toner becomes exhausted during the image forming operation, the apparatus discontinues image forming, and calls upon the user to interchange the toner bottle 15 by a message or the like on the display of the operating portion.

(2) A sensor signal for opening the front cover is detected.

(3) A signal for closing the front cover is again detected, and it is judged that the toner bottle 15 has been interchanged, and the display of the operating portion is returned to the ordinary display.

(4) The recovery operation is started. After it is completed, image forming is resumed.

5) Image forming is resumed, but the toner bottle 15 has not been interchanged and therefore, toner absence is immediately displayed.

If as described above, only the detection of the opening and closing of the front cover is used as a judgment signal for the interchange of the toner bottle 15, when the user performs abnormal action, the display of the operating portion is returned to the ordinary display or the recovery operation is repeated many times, in spite of the toner bottle 15 having not been interchanged.

To solve this, it is conceivable to discretely provide detecting means capable of detecting the presence or absence of the toner bottle 15 itself, but this will result in the rise of the cost of the apparatus and the complication of the apparatus, and is not advisable.

SUMMARY OF THE INVENTION

It is an object of the present invention to provide a toner supplying container of which the opening and closing of the shutter can be detected.

It is another object of the present invention to provide a toner supplying container of which both of the presence or absence of the mounting and the opening and closing of the shutter can be detected.

It is another object of the present invention to provide a toner supplying container detachably mountable to the main body of an image forming apparatus for supplying a toner, and having a container body for containing the toner therein, a toner discharging port provided in the container body, a shutter for opening and closing the toner discharging port, and a portion to be detected provided at a location corresponding to an optical sensor provided in the image forming apparatus for detecting the position of the shutter.

It is another object of the present invention to provide an image forming apparatus in which the stain of an optical sensor for detecting the opening and closing of the shutter of a toner supplying container can be reduced as much as possible.

It is another object of the present invention to provide an image forming apparatus in which the stain of an optical sensor for detecting the presence or absence of the mounting of a toner supplying container can be reduced as much as possible.

It is another object of the present invention to provide an image forming apparatus in which both of the opening and closing of the shutter of a toner supplying container and the presence or absence of the mounting of the toner supplying container can be detected by an optical sensor.

It is another object of the present invention to provide an image forming apparatus in which is detachably mounted a toner supplying container having a container body for containing a toner therein, a toner discharging port provided in the container body, and a shutter for opening and closing the toner discharging port, and which comprises an interchange door openable and closable for the interchange of the toner supplying container, and an optical sensor provided on the inner surface of the interchange door for detecting the position of the shutter.

It is another object of the present invention to provide an image forming apparatus in which a toner supplying container is detachably mounted and which comprises an interchange door openable and closable for the interchange of the toner supplying container, and an optical sensor provided on the inner surface of the interchange door to detect whether the toner supplying container is mounted.

Further objects of the present invention will become apparent from the following detailed description when read with reference to the accompanying drawings.

BRIEF DESCRIPTION OF THE DRAWINGS

FIG. 1A is a front view showing a state in which a bottle interchange door is opened. FIG. 1B is a perspective view showing the state in which the bottle interchange door is opened.

FIG. 5A is a front view of the toner bottle. FIG. 5B is a perspective view of a portion of the toner bottle.

DESCRIPTION OF THE PREFERRED EMBODIMENTS (First Embodiment)

Figure 1A:
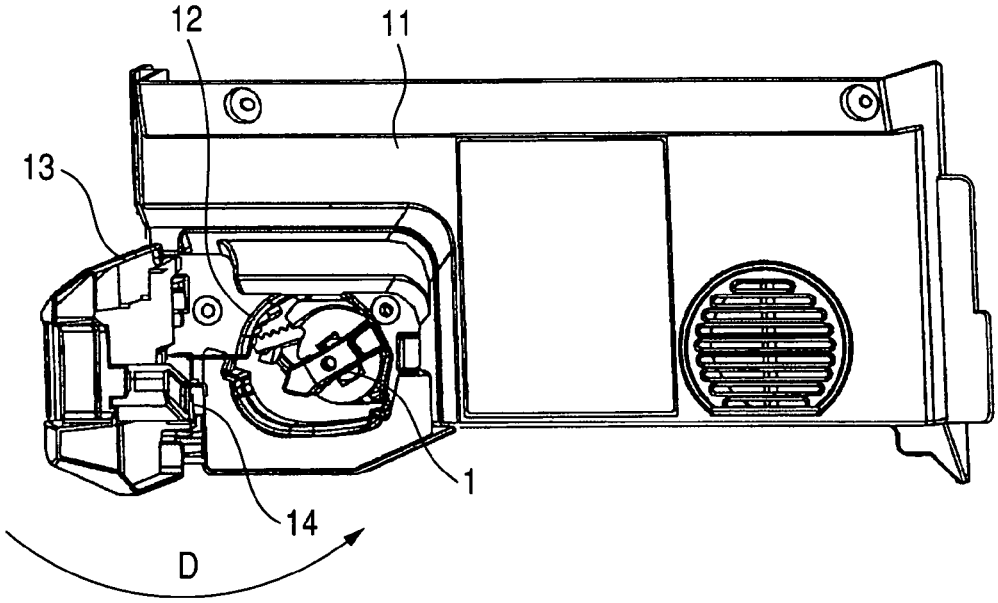
FIGS. 1A and 1B are illustrations of a first embodiment.
Figure 1B:
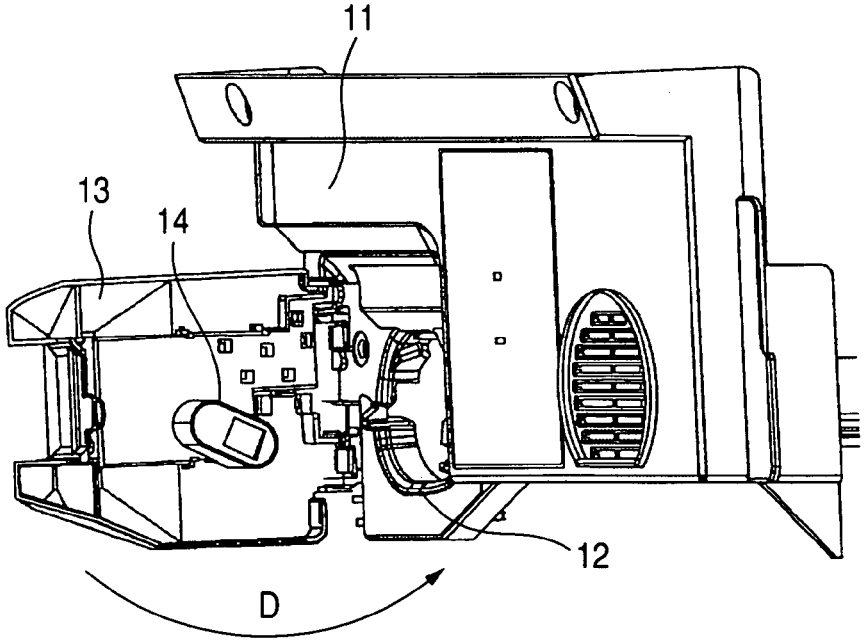

A first embodiment of the present invention will hereinafter be described with reference to FIGS. 1A and 1B. The construction of a toner bottle 15 is substantially similar to the construction described in the foregoing example of the conventional art except the construction of the portion to be detected. Accordingly, the functionally same regions as those in the example of the conventional art are given the same reference characters and need not be described in detail. FIGS. 1A and 1B are schematic views of a portion of an image forming apparatus to which the present invention can be applied.

The reference numeral 13 designates a bottle interchange door as an openable and closable door openably and closably provided to interchange a toner bottle 15 as a toner supplying container, and the reference numeral 14 denotes a reflection type sensor having a light emitting element and a light receiving element integrally with each other as an optical sensor.

FIG. 1A is a front view showing a state in which the bottle interchange door 13 is opened, and FIG. 1B is a perspective view thereof. The reflection type sensor 14 is installed on the inner surface of the bottle interchange door 13 so as to correspond to the portion to be detected of a bottle knob 1 when the bottle interchange door 13 is pivotally moved in the direction of arrow D and closed.

The construction of the optical sensor is not restricted to the above-described example, but may be a construction in which the light emitting element and the light receiving element are discrete from each other. In this case, the light receiving element as the optical sensor may be of a construction capable of receiving reflected light from the portion to be detected.

Figure 2:
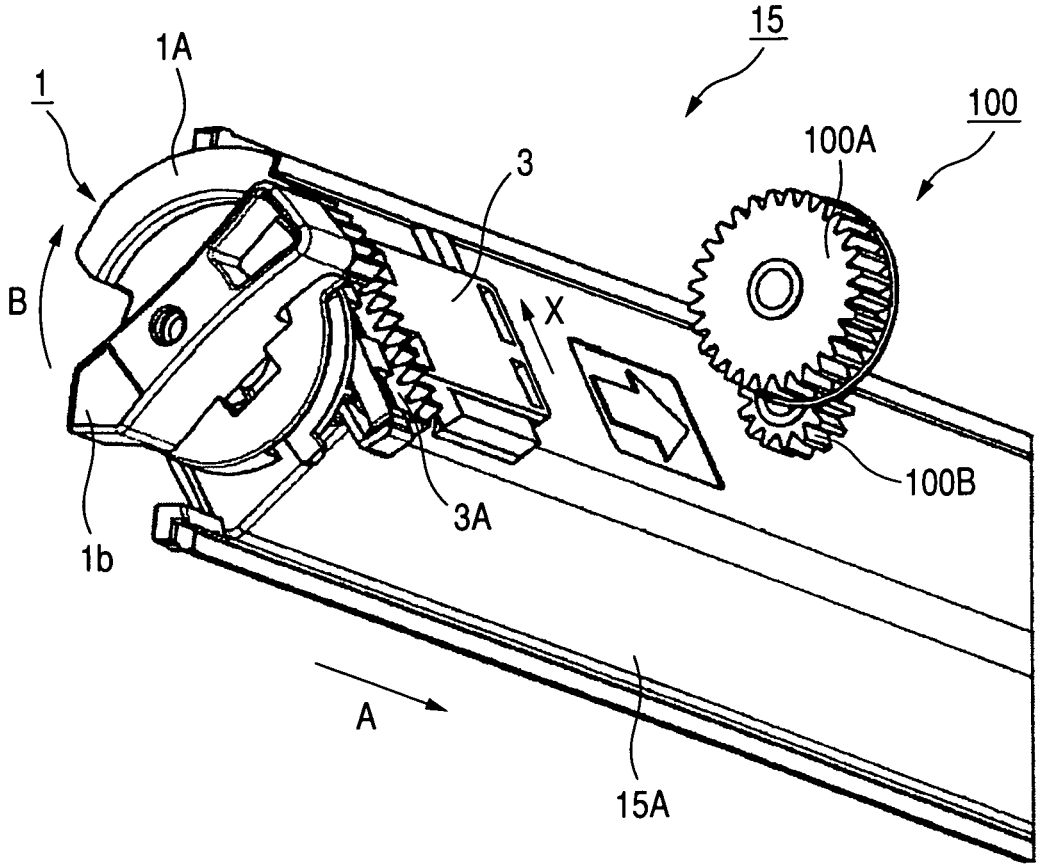
FIG. 2 shows a situation immediately before a toner bottle is mounted on the mounting portion of an image forming apparatus.
Figure 3:
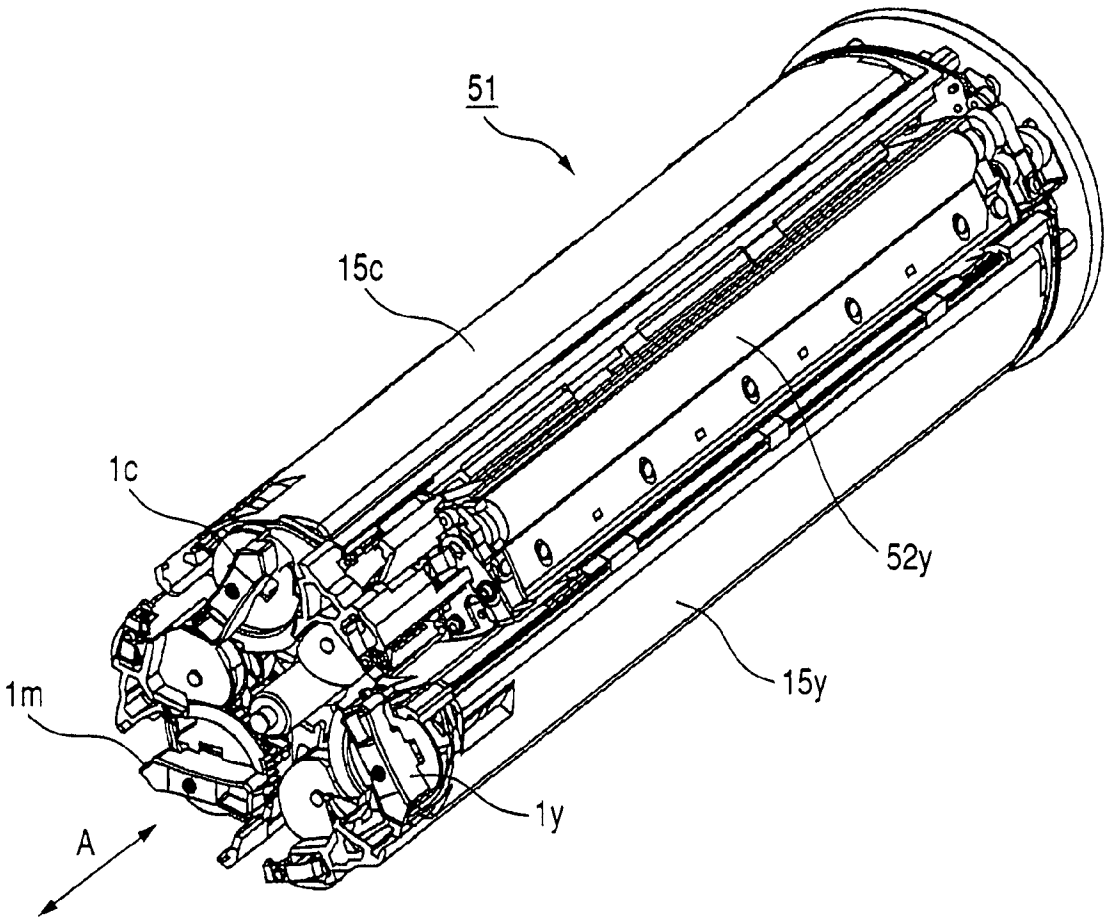
FIG. 3 PRIOR ART
FIG. 3 is a perspective view of a developing rotary.
Figure 4:
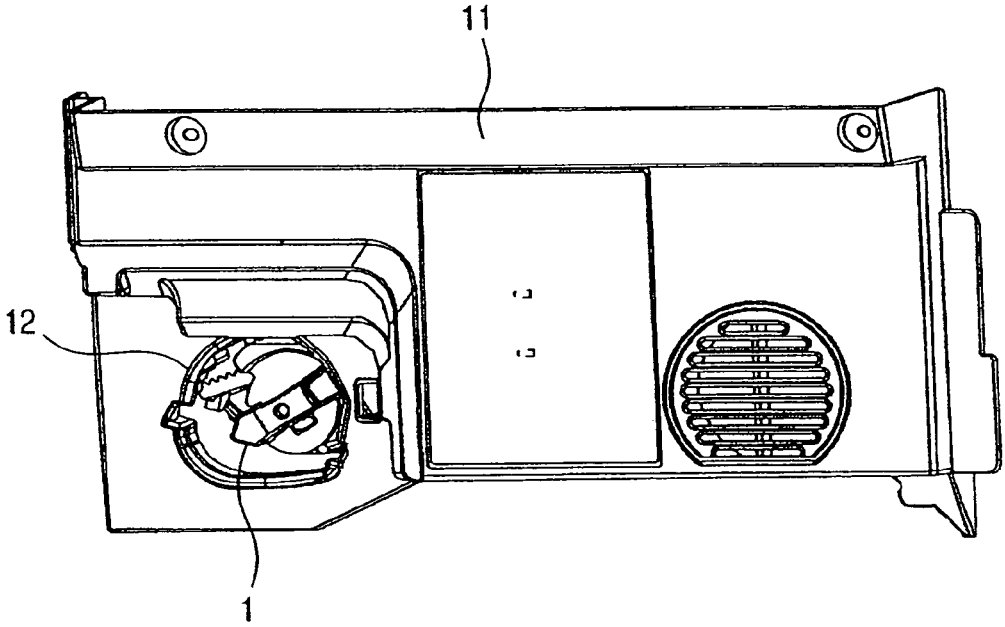
FIG. 4 PRIOR ART
FIG. 4 is a schematic view of the toner bottle mounted on the developing rotary.
Figure 5A:
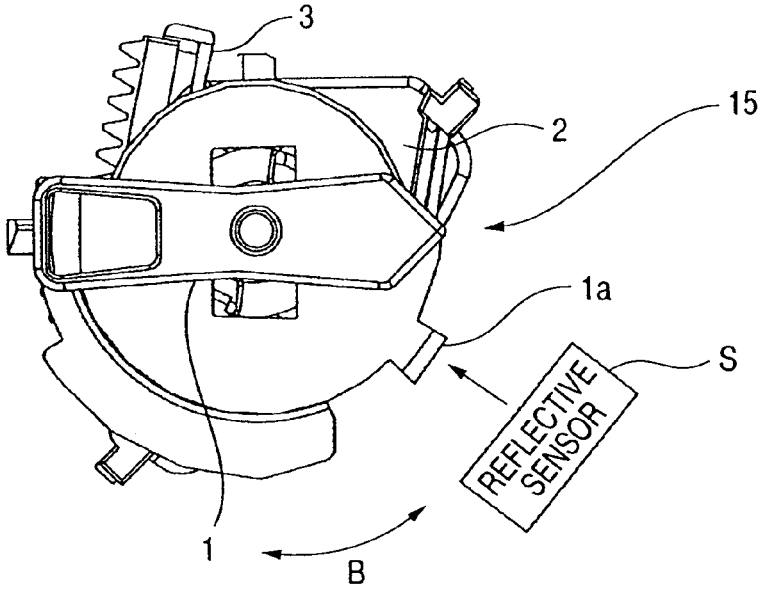
FIG. 5A PRIOR ART
FIGS. 5A and 5B are illustrations of the knob portion of the toner bottle.

Although described in the foregoing example of the conventional art, the construction of the toner bottle 15 will be described again with reference to FIG. 2 (with reference also to FIGS. 5A and 5B as required). FIG. 2 shows a situation immediately before the toner bottle 15 is mounted on the mounting portion of the image forming apparatus. Also, in FIG. 2, drive transmitting means 100 alone which will be described later is picked out and depicted as the construction of the image forming apparatus side.

The toner bottle 15 has a bottle body 15A as a container body for containing a toner therein, a toner discharging port (in FIG. 2, closed by a shutter 3 which will be described later) provided in the bottle body 15A, and a shutter 3 for opening and closing the toner discharging port.

Further, the toner bottle 15 is provided with a bottle knob 1 as a rotating member provided for pivotal movement relative to the bottle body 15A. This bottle knob 1 is designed such that at a point of time before the toner bottle 15 is mounted in the image forming apparatus, a lock portion provided on the bottle knob 1 is locked to the portion to be locked of the bottle body 15A and becomes substantially unrotatable. On the other hand, design is made such that when the toner bottle 15 is mounted in the image forming apparatus, the lock portion of the bottle knob 1 strikes against the image forming apparatus and is displaced, whereby the locking thereof to the portion to be locked of the bottle body 15A is released and the pivotal movement of the bottle knob 1 in a direction B is permitted relative to the bottle body 15A. This construction makes it possible that at this state, a user grasps a grip (a portion on which a reflecting surface 1*b* is provided as described later in conjunction with F*ig*.2) of the bottle knob 1 to rotate the bottle knob 1.

The shutter 3 is formed with a gear portion 3A which receives a moving force for opening and closing the toner discharging port.

Figure 5B:
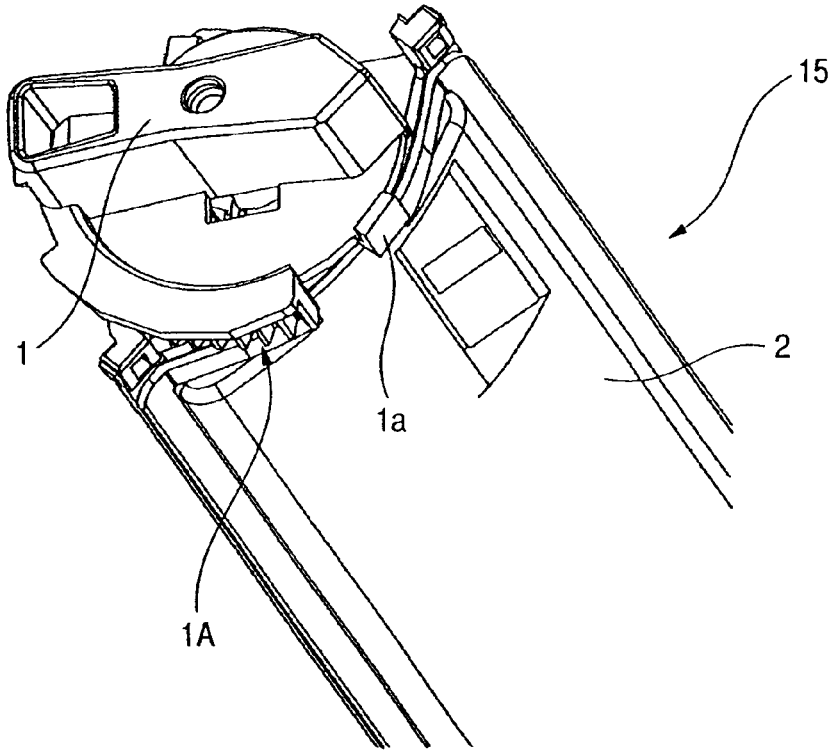
FIG. 5B PRIOR ART

On the other hand, the bottle knob 1 is also formed with a gear portion 1A (see FIG. 5B).

The gear portion 3A of the shutter 3 and the gear portion 1A of the bottle knob 1 are not drive-connected to each other at a point of time before the toner bottle 15 is mounted in the image forming apparatus.

These two gear portions 1A and 3A, however, are designed to be drive-connected to drive transmitting gears 100A and 100B as drive transmitting means 100 disposed on the mounting portion of the image forming apparatus when the toner bottle 15 is mounted in a direction A toward the image forming apparatus. The drive transmitting means 100 has a gear 100C rotatable coaxially with the gear 100A on the back side of the gear 100A, but this gear 100C is hidden behind the gear 100A in FIG. 2.

Accordingly, design is made such that when the gears 100A and 100C are rotated, the gear 100B which is in meshing relationship with the gear 100C is rotated. That is, the gear 100A and the gear 100B are brought into drive-connected relationship with each other through the gear 100C.

That is, the gear portion 3A of the shutter 3 and the gear portion 1A of the bottle knob 1 are designed to be drive-connected to each other through the drive transmitting means 100 by the toner bottle 15 being mounted in the image forming apparatus.

When in a state in which the gear portion 3A and the gear portion 1A have been drive-connected to each other as described above, the bottle knob 1 is pivotally moved by a predetermined angle in the direction B, a rotating force produced by this pivotal movement of the bottle knob 1 is transmitted to the gear portion 3A of the shutter 3 through the drive transmitting means 100, and the shutter 3 is moved in a direction X to a position for opening the toner discharging port. The bottle knob 1 being in the thus pivotally moved position is designed to strike against the mounting portion of the image forming apparatus so that the toner bottle 15 may not be drawn out by mistake.

On the other hand, when from this state, the bottle knob 1 is pivotally moved by a predetermined angle in a direction opposite to the direction B, a rotating force produced by this pivotal movement of the bottle knob 1 is transmitted to the gear portion 3A of the shutter 3 through the drive transmitting means 100, and the shutter 3 is moved to a position for closing the toner discharging port in a direction opposite to the direction X.

The toner bottle 15 is designed to be mounted to and detached from the image forming apparatus only when the shutter 3 is in its closed state, that is, only when the bottle knob 1 is in a posture in which it has closed shutter 3 (a posture before mounting).

The toner bottle 15 is also designed to be mounted in the image forming apparatus so as to be substantially unrotatable.

Next, the bottle knob 1 is provided with a reflecting surface 1*b* as a portion to be detected for reflecting light emitted from the light emitting element of the reflection type sensor 14 toward the light receiving element of the reflection type sensor 14 (has a light-reflecting tape stuck thereon). This reflecting surface 1*b* is provided on a surface along a direction perpendicular to a toner bottle mounting direction A.

This reflection type sensor 14 is designed to detect that the bottle knob 1 is in a position in which it has been pivotally moved by a predetermined angle to open the shutter 3. At the same time, this reflection type sensor 14 also has the function of detecting whether the toner bottle 15 is mounted in the image forming apparatus.

That is, design is made such that when in a state in which the bottle knob 1 has closed the shutter 3, the bottle interchange door 13 is closed, the light emitted from the light emitting element of the reflection type sensor 14 to the toner bottle 15 is hardly reflected by the toner bottle 15 and sufficient light is not incident on the light receiving element of the reflection type sensor 14.

Also, design is made such that when the bottle interchange door 13 is closed with the toner bottle 15 not mounted in the image forming apparatus, light emitted from the reflection type sensor 14 toward a space (mounting portion) for mounting the toner bottle 15 is hardly reflected by the inner port side of this space and sufficient light is not incident on the light receiving element of the reflection type sensor 14.

Accordingly, a CPU as a controller monitors a signal from such a reflection type sensor 14, whereby both of the position of the bottle knob 1, i.e., the opening and closing of the shutter 3, and the presence or absence of the mounting of the toner bottle 15 can be detected. That is, a single optical sensor can perform two different functions and thus, a reduction in the cost of the image forming apparatus can be achieved.

The reflecting surface 1*b* is a surface perpendicular to the rotary shaft of the rotary member 51 and also perpendicular to the rotary shaft of the bottle knob 1. These two rotary shafts are parallel with each other and are also parallel to the ground.

In whatever operating state the apparatus may be, the reflecting surface 1*b* is always in a plane perpendicular to the ground.

By adopting such an arrangement, it is possible to make a construction difficult for the toner to adhere to and stain the reflecting surface 1*b*.

Further, even if the reflecting surface 1*b* should be stained, an operator can readily perform the cleaning of this reflecting surface 1*b* because of a construction in which the reflecting surface 1*b* becomes exposed with the opening 12 of the bottle interchange door 13.

Also, the optical sensor 14 is provided on the inner surface of the bottle interchange door 13 and even though it is inside the image forming apparatus, it is near to the external portion side and therefore, it is of a construction in which it is difficult for the toner to adhere to and stain it.

Further, even if a transparent window portion provided so as to cover the light emitting element and light receiving element of the optical sensor should be stained with toner, the operator can readily perform the cleaning of the reflecting surface 1*b* because of a construction in which the window portion is opened with the bottle interchange door 13 and the reflecting surface 1*b* becomes exposed.

The operating state will now be described.

A description will first be made of the user's operation. The following is a normal procedure.

(1) During the image forming operation, the toner becomes exhausted and image forming is discontinued and therefore, the user is called upon to interchange the toner bottle 15 by a message on the display of the operating portion.

(2) The user opens the front cover of the apparatus (not shown), and further opens the bottle interchange door 13.

(3) The user starts to interchange the toner bottle 15 with reference to an interchanging method or the like displayed on the display of the operating portion.

(4) The user rotates the bottle knob 1 by a predetermined angle to thereby release the toner bottle 15 from the rotary member 51.

(5) The user draws out the toner bottle 15 toward this side of the apparatus.

(6) The user inserts a new toner bottle 15.

(7) The user rotates the bottle knob 1 by a predetermined angle to thereby fix it.

(8) The user closes the bottle interchange door 13.

(9) The user closes the front cover.

Movements in the image forming apparatus corresponding thereto are as follows.

(1) When the toner becomes exhausted during the image forming operation, the apparatus discontinues image forming and calls upon the user to interchange the toner bottle 15 by a message or the like to the display of the operating portion.

(2) A sensor signal for the opening of the front cover is detected and further, the sensor 14 comes not to receive the reflected light from the reflecting surface 1*b*, whereby the opening of the bottle interchange door 13 is detected.

(3) In response to the signal, the display of the operating portion is changed over to the display of an interchange procedure or the like.

(4) to (7) (There is no change during the user's interchanging of the toner bottle 15.)

(8) The sensor 14 receives reflected light from the reflecting surface 1*b*, whereby the closing of the bottle interchange door 13 is detected. In response to the signal, the display of the operating portion is changed over to a display for calling upon the user to close the front cover.

(9) The closing of the front cover is detected, and the display of the operating portion is returned to the ordinary display. The recovery operation is started, and after it is completed, image forming is resumed.

An example of the user's abnormal action will now be described.

(1) The toner becomes exhausted during the image forming operation, and image forming is discontinued and therefore, the user is called upon to interchange the toner bottle 15 by a message on the display of the operating portion.

(2) The user opens the front cover of the apparatus (not shown).

(3) The user, however, becomes aware of having prepared a toner bottle 15 of a wrong color, and again closes the front cover.

(4) The user prepares a right toner bottle 15, and again opens the front cover. (Thereafter, the user performs normal action.)

Movements in the image forming apparatus corresponding thereto are as follows.

(1) When the toner becomes exhausted during the image forming operation, the apparatus discontinues image forming, and calls upon the user to interchange the toner bottle 15 by a message or the like to the display of the operating portion.

(2) A sensor signal for the opening of the front cover is detected.

(3) A signal for the closing of the front cover is detected again. There has been no opening-closing detection signal of the bottle interchange door 13 and therefore, the display of the operating portion continues to display the message calling upon the user to interchange the toner. The apparatus neither performs the recovery operation.

(4) (Thereafter, the apparatus performs a normal operation.)

As described above, as long as the bottle interchange door 13 is not opened and closed, the display of the operating portion is maintained on the toner interchange display, and an unnecessary recovery operation is not performed.

Consequently, an apparatus friendly to the user can be provided without increasing the cost of the apparatus.

(Second Embodiment)

While the first embodiment is one in which the toner bottle 15 as a toner supplying container is interchanged, the present invention is also applicable to an image forming apparatus of a construction in which a so-called developing cartridge comprising a developing device and a toner supplying container made integral with each other is interchanged. The toner supplying container in the present embodiment, unlike the first embodiment, is for supplying the toner to the developing device.

(Third Embodiment)

While the first embodiment is of a construction in which the toner bottle and the bottle knob are interchanged integrally with each other, in this embodiment, an operating lever as a pivotally movable member corresponding to the bottle knob is provided on the apparatus main body or a developing rotary as a rotary member.

This lever is pivotally moved, whereby the opening and closing of the shutter of the toner bottle are effected. Also, in the case of a process cartridge, this lever is pivotally moved, whereby the fixing (locking and the release of fixing thereof to the apparatus is effected. A reflecting surface as a portion to be detected is provided on an end surface of this lever, and an optical sensor is provided on the inner surface of the interchange door so as to correspond to this reflecting surface. Even in such a construction, the toner stain on the optical sensor can be reduced as much as possible, and the cleaning of the optical sensor can be done easily.

As described above, the sensor 14 is far from a portion handling the toner and the detecting surface 1*b* of the bottle knob 1 is substantially parallel with a vertical direction and therefore, it is difficult for the toner to adhere to and stain the detecting surface 1*b*. Further, when the detecting surface 1*b* is stained, it can be cleaned easily if the bottle interchange door 13 is opened, and this leads to a good working property.

Also, the sensor 14 can not only detect whether the toner bottle 15 is properly set, but also detect the opened and closed states of the bottle interchange door 13 because a detection signal is operatively associated with the opening and closing of the bottle interchange door 13. On the basis of the detection signal, a message to the operating portion which is a liquid crystal display portion provided on the upper portion of the image forming apparatus can be changed over, and fair judgment as to whether the user has interchanged the toner bottle 15 can be passed.

Also, the reflecting surface 1*b* of the bottle knob is provided on this side with respect to the mounting direction of the toner bottle 15, whereby it becomes difficult for the user to touch this reflecting surface 1*b* when they perform the operation of mounting or dismounting the toner bottle 15, and such a problem as faulty reflection attributable to the damaging of the reflecting surface 1*b* or the stain of the reflecting surface 1*b* can be prevented.

While in the above-described embodiment, the optical sensor 14 detects the position of the bottle knob 1 to thereby detect the opening and closing of the shutter 3 and the presence or absence of the mounting of the toner bottle 15, such an example is not restrictive, but such a construction as will be described next may be adopted. For example, a construction in which a similar reflecting surface 1*b* is provided on the side edge portion of the shutter 3 and it is detected by the optical sensor 14 can also obtain a similar effect. However, when the cleanability of the reflecting surface 1*b* is taken into consideration, the construction in which the reflecting surface 1*b* is provided on the bottle knob 1 is more preferable.

As described above, according to the above-described embodiment, the toner stains of the sensor 14 and the portion to be detected can be prevented. Also, even if the toner adheres to them, it becomes possible to readily effect the cleaning of them.

Further, both of the opening and closing of the shutter 3 and the presence or absence of the mounting of the toner bottle 15 can be detected by a single optical sensor 14 to thereby achieve a reduction in the cost of the image forming apparatus. That is, there can be provided a toner bottle 15 corresponding to such a reduction in the cost of the image forming apparatus.

The detection of the opened and closed states of the bottle interchange door 13 also becomes possible by this optical sensor 14 and the more simplification of the construction can be achieved.

What is claimed is:

1. A toner supplying container detachably mountable to an image forming apparatus for supplying a toner, said toner supplying container comprising:

a container body for containing the toner;

a toner discharging port provided in said container body;

a shutter for opening and closing said toner discharging port;

a detection portion for detection of a position of said shutter by an optical sensor provided in said image forming apparatus; and a rotating member for rotating relative to said container body to move said shutter so as to be opened and closed, wherein said detection portion is provided on said rotating member.

2. A toner supplying container according to claim 1, wherein when said container body is in a state in which said container body has been substantially unrotatably mounted in said image forming apparatus, said rotating member becomes rotatable relative to said container body.

3. A toner supplying container according to claim 1, wherein said detection portion is provided with a light reflecting member.

4. A toner supplying container according to claim 1, further comprising a grip provided on said rotating member, wherein said detection portion is provided on a surface of said grip.

5. A toner supplying container according to claim 1, wherein a surface, to be detected by said optical sensor, of said detection portion is disposed parallel with a direction of gravitational force.

6. An image forming apparatus to which a toner supplying container is detachably mountable, the toner supplying container having a container body for containing a toner, a toner discharging port provided in the container body, and a shutter for opening and closing the toner discharging port, said image forming apparatus comprising:

an interchange door openable and closable for interchange of the toner supplying container; and an optical sensor provided on an inner surface of said interchange door for detecting a position of the shutter when said interchange door is closed.

7. An image forming apparatus according to claim 6, wherein said optical sensor detects an opening of the shutter.

8. An image forming apparatus according to claim 7, wherein the toner supplying container has a rotating member for rotating relative to the container body to move the shutter so as to be opened and closed, and said optical sensor receives light reflected by said rotating member being in a position when said shutter is moved to an open position.

9. An image forming apparatus according to claim 7, wherein said optical sensor is capable of detecting whether the toner supplying container is mounted.

10. An image forming apparatus according to claim 7, wherein said optical sensor is capable of detecting whether said interchange door has been opened.

11. An image forming apparatus according to claim 7, further comprising a rotary member rotatable with a plurality of toner supplying containers held on said rotary member, wherein said plurality of toner supplying containers are detachably mountable through said interchange door to said rotary member.

12. An image forming apparatus to which a toner supplying container is detachably mountable, said image forming apparatus comprising:

an interchange door openable and closable for interchange of the toner supplying container; and an optical sensor provided on an inner surface of said interchange door to detect whether said toner supplying container is mounted when said interchange door is closed.

13. An image forming apparatus according to claim 12, wherein said toner supplying container includes a rotating member for rotating relative to a container body to move a shutter so as to be opened and closed, wherein said optical sensor receives light reflected by said rotating member being in a position when said shutter is moved to an open position.

14. An image forming apparatus according to claim 12, wherein said optical sensor is capable of detecting whether said toner supplying container is mounted.

15. An image forming apparatus according to claim 12, wherein said optical sensor is capable of detecting whether said interchange door has been opened.

16. An image forming apparatus according to claim 12, further comprising a rotary member rotatable with a plurality of toner supplying containers held on said rotary member, wherein said plurality of toner supplying containers are detachably mountable through said interchange door to said rotary member.

17. An image forming apparatus to which a toner supplying container is detachably mountable, the toner supplying container including a container body for containing a toner, a toner discharging port provided in the container body, and a shutter for opening and closing the toner discharging port, said image forming apparatus comprising:

a mounting portion to which the toner supplying container is mounted;

a door provided at an entrance of said mounting portion, said door being openable and closable for interchange of the toner supplying container;

drive transmitting means drive-connected to both of the shutter and a rotary member provided on one end side of the toner supplying container when the toner supplying container is mounted to said mounting portion for transmitting a drive applied to the rotary member to the shutter to open and close the shutter;

an optical sensor provided on an inner surface of said door to detect whether a detection portion provided on the rotary member is in an opposite position when said door is closed; and means for judging an opening or closing state of the shutter based on a detection result of said optical sensor.

18. An image forming apparatus to which a toner supplying container is detachably mountable, the toner supplying container including a container body for containing a toner, a toner discharging port provided in the container body, and a shutter for opening and closing the toner discharging port, said image forming apparatus comprising:

a mounting portion to which the toner supplying container is mounted;

a door provided at an entrance of said mounting portion, said door being openable and closable for interchange of the toner supplying container;

drive transmitting means drive-connected to both of the shutter and a rotary member provided on one end side of the toner supplying container when the toner supplying container is mounted to said mounting portion for transmitting a drive applied to the rotary member to the shutter to open and close the shutter;

an optical sensor provided on an inner surface of said door to detect whether a detection portion provided on the rotary member is in an opposite position when said door is closed; and means for judging a presence or absence of a mounted toner supplying container based on a detection result of said optical sensor.

* * * * *